US005290424A

United States Patent [19]

Mozelewski et al.

[11] Patent Number: 5,290,424

[45] Date of Patent: Mar. 1, 1994

[54] METHOD OF MAKING A SHAPED REFLECTIVE ALUMINUM STRIP, DOUBLY-PROTECTED WITH OXIDE AND FLUOROPOLYMER COATINGS

[75] Inventors: Frank A. Mozelewski, Lower Burrell; Daniel L. Serafin, Wexford; Robert E. Bombalski, Brackenridge; Romeo C. Pascasio, Lower Burrell; Donald L. Nock, New Kensington, all of Pa.

[73] Assignee: Aluminum Company of America, Pittsburgh, Pa.

[21] Appl. No.: 830,021

[22] Filed: Jan. 31, 1992

[51] Int. Cl.[5] ..... C25D 7/08; C25D 11/08

[52] U.S. Cl. ..... 205/116; 156/272.6; 205/153; 205/201; 205/213

[58] Field of Search ..... 205/201, 202, 203, 204, 205/139, 153, 213, 116; 156/272.6

[56] References Cited

U.S. PATENT DOCUMENTS

| | | | |
|---|---|---|---|
| 4,025,681 | 5/1977 | Donnelly et al. | 428/116 |
| 4,085,012 | 4/1978 | Marceau et al. | 428/469 X |
| 4,298,440 | 11/1981 | Hood | 204/165 |
| 4,331,479 | 5/1982 | Toyama | 430/147 |
| 4,345,057 | 8/1982 | Yamabe et al. | 526/247 |
| 4,483,750 | 11/1984 | Powers | 205/116 |
| 4,490,184 | 12/1984 | Forcht et al. | 148/6.21 |
| 4,654,238 | 3/1987 | Yamazaki et al. | 428/31 |
| 4,681,668 | 7/1987 | Davies et al. | 428/469 |
| 4,929,319 | 5/1990 | Dinter et al. | 204/165 X |
| 5,131,987 | 7/1992 | Nitowski et al. | 205/201 |

*Primary Examiner*—John Niebling
*Assistant Examiner*—William T. Leader
*Attorney, Agent, or Firm*—Alfred D. Lobo; David W. Brownlee

[57] ABSTRACT

A shaped strip of highly reflective aluminum protected by an anodic oxide coating and a light-permeable fluoropolymer coating which is non-adhesively interstitially mechanically bonded to the microscopic irregularities of the anodic oxide surface. There is no adhesive used to obtain chain entanglement. The highly reflective strip may be substituted for polished stainless steel and/or bi-metal and used under comparably aggressive conditions for a prolonged period without deleteriously affecting the initial D/I (distinctness of reflected image) of the shaped strip. The strip of arbitrary length is shaped in rolling dies so that at least a portion of the strip has a radius of less than 10 mm without damaging or separating the fluoropolymer coating. The specific steps of the claimed process require starting with a clean strip which is brightened to a nearmirror-like finish, then treated to carry a thin porous aluminum oxide coating in a phosphoric acid bath under direct current (DC). After rinsing and drying, the reflective surface is coated with the fluoropolymer while maintaining at least 80% D/I. The strip, now dual-coated, is then formed to a desired profile. The dual-coated strip, in turn, may be treated with a corona discharge to activate its surface so as to non-adhesively bond an adhesive chosen to bond a thermoplastic strip of synthetic resin to the activated fluoropolymer surface.

12 Claims, 2 Drawing Sheets

METHOD OF MAKING A SHAPED REFLECTIVE ALUMINUM STRIP, DOUBLY-PROTECTED WITH OXIDE AND FLUOROPOLYMER COATINGS

BACKGROUND OF THE INVENTION

Steel sheet with a silvered polymer film laminated to it, and formed to a desirable shape, has gained wide market acceptance for use in lighting fixtures where cost is a secondary consideration, as for example, for light in hospital operating rooms. Relatively less expensive lighting fixtures are made from mild steel painted with a paint containing a white opaque powder having high total reflectance but low distinctness of (reflected) image ("D/I" for brevity). Narrow polished, bright sheets (referred to as "strips") of stainless steel and/or stainless steel clad aluminum (referred to as "bi-metal"), appropriately shaped, are also widely used for decorative trim in automobiles, trucks, boats and a variety of both household and industrial appliances because such decorative trim is eminently durable under aggressive conditions of use. The increasing cost of stainless steel sheet has provided the impetus to replace decorative stainless steel trim with brightened aluminum trim.

The problem is that a brightened, coated and shaped reflective aluminum strip, provided with the protection afforded by any one or more of known coatings, whether inorganic or organic, or both, fails to meet numerous tests which are deemed essential if reflective aluminum trim is to be substituted for the polished stainless steel trim.

This invention relates generally to a shaped, aluminum article having substantially mirror-like characteristics, formed by continuously shaping a "strip" of fluoropolymercoated aluminum alloy, for example, in a roll-forming die, which provides the strip with at least one "tight" radius which is less than 10 mm (0.375 inch). By "substantially mirror-like characteristics" is meant that the surface is characterized by having at least 75% and preferably at least 80% D/I. D/I is expressed as a percentage of specular reflectance $R_s$. D/I is the sharpness of the reflected image as measured by the ratio of the reflectance at 0.3° from specular to the reflectance at the specular angle, that is, $$D/I=((R_s-R_{0.3})/R_s)\times 100\%$$

D/I=0 for a perfect diffuser; D/I=100 for a perfect mirror. Total reflectance of a surface is irrelevant in a consideration of its D/I.

The term "strip" is used herein to specify a relatively narrow and thin sheet of anodized aluminum reflector alloy in the range from about 1 cm to 1 meter wide, preferably from 2 cm to 30 cm wide, and from about 0.5 mm to about 5 mm thick. At least one surface of the shaped article is doubly-protected by a dual-coating consisting essentially of an oxide coating produced by a phosphoric acid ($H_3PO_4$) anodizing treatment, the oxide coating, in turn being coated with a cold-workable, environmentally stable, essentially light-permeable coating of a matrix of curable fluoropolymer which is preferably deposited from a solution thereof, on the oxide coating. Hereafter, all references to "aluminum" describe a generally high purity aluminum alloy known, when cleaned and brightened for the purpose at hand with due attention to details of known processes, produces a substantially mirror-like surface The term "matrix fluoropolymer" is used to highlight the characteristic interchain configuration of the polymer which allows it to be interstitially mechanically bonded to the anodized surface of the reflective aluminum strip, and also to infer that such chain configuration, upon curing of the polymer, produces a receptive substrate which if appropriately treated, will provide a receptive surface in which an adhesive may, in turn, be bonded. Interstitial mechanical bonding is evidenced by chain entanglement of the cured fluoropolymer with a multiplicity of tendrils and pores defined generally by the oxide structure of short columns (schematically illustrated in FIG. 1 and described in greater detail hereafter) which define shallow pores obtained by phosphoric acid anodizing the surface of the reflective aluminum strip. Such chain entanglement is also referred to as a "key-in-lock" structure which allows the anodized surface to grip the surface of the overlaid polymer.

Accordingly, this invention relates to a method of coating a chemically cleaned, chemically brightened but non-etched and anodized strip of mirror-like aluminum alloy with an essentially transparent, durable, weather-resistant, fluoropolymer coating. By "transparent" we refer to a coating which is essentially light-permeable, that is, at least 80% permeable to visible light.

More specifically, this invention relates to the foregoing doubly-protected reflective strip of shaped aluminum which, after being shaped and thereafter being exposed to alternating cycles of ultraviolet (UV) light and 100% humid conditions (commonly referred to as QUV/UVCON) for a prolonged period (i) maintains at least a 80% D/I, and (ii) maintains adhesion of the fluoropolymer coating after the strip is bent in a "Half-T Bend test". In such a test an end portion of the strip is bent double upon the remaining portion, that is, the strip is doubly bent, referred to as a "Zero-T Bend"; the remaining portion is then bent again, first over the end portion, then bent around the small radius formed at the bend of the doubly bent portions of the strip, so that the end portion is sandwiched between the bent portions of the remaining portion (see ASTM D-3794-79). Thus, the "Half-T Bend" is a less stringent test than the "Zero-T Bend" test. The doubly-protected strip of this invention typically meets the more stringent test.

Still more specifically, this invention relates to the foregoing doubly-protected strip, which after being formed to include at least one tight radius, may be laminated to a strip of thermoplastic polymer which is adhesively secured to the exposed surface of the fluoropolymer, provided the surface of the fluoropolymer is treated with a corona (or electric) discharge which "primes" the surface sufficiently to provide interstitial bonding for the adhesive.

Accordingly, this invention also relates to a method of coextruding a strip of electrically primed, polymer-coated reflective aluminum strip and a strip of thermoplastic synthetic resin adhesively bondable thereto, forming laminated decorative trim, for example, automotive trim.

Even organic coatings known to be adherent to smooth, cleaned and brightened surfaces which are conventionally anodized, either do not bond acceptably or do not meet the D/I requirements for the surface of a strip of marketable trim, or both, particularly if such requirements are to be met after exposure outdoors, referred to herein as "aging". Only a curable fluoropolymer, upon being cured, preferably thermally, if acceptably bonded to the strip so that it may be roll-formed, meets the many properties required of decorative reflective aluminum trim.

As will be evident, since the mirror-like surface of substantially pure aluminum must be protected, it is conventionally anodized. However, even a relatively thin (7.6 μm or 0.3 mil) anodized coating formed by phosphoric acid anodizing, after being coated with the most preferred matrix fluoropolymer used in this invention, and acceptably bonded to the coating, is found, upon aging, to "craze" or crack when it is formed or coextruded into an article of arbitrary length and cross section in which at least one radius is less than 10 mm. A sulfuric acid anodized strip of the same aluminum coated with an oxide layer 0.08 mil (2 μm) thick, identically coated with the same fluoropolymer, also shows crazing when bent around a 10 mm mandrel. Because we discovered that only the matrix fluoropolymer coating combines all the necessary qualities to pass the most stringent requirements for such an article, it became necessary to find and provide an anodized coating which was sufficiently thick to afford both, the desired protection and also an adequate key-in-lock structure which would lock in and bond the matrix fluoropolymer. However the combination of anodized coating and fluoropolymer could not be so thick as to vitiate the D/I of the strip, or be unduly susceptible to crazing and cracking after aging.

Surprisingly, when the mirror-like reflective aluminum sheet is protected by an oxide coating produced by phosphoric acid anodizing ("PAA"), under specified conditions, the relatively thin oxide structure produced by short columns which define shallow open pores, affords an excellent grip for the matrix fluoropolymer coating without substantially sacrificing its reflected image clarity and other optical properties, yet is able to withstand a sharp bend without crazing. By "without substantially sacrificing its reflected image clarity" we mean that the D/I measured with a Hunter Lab D-47 DORI-gON (according to ASTM-E430) is decreased by less than 10 percent, preferably less than 5%, when measured within 24 hr after an organic coating at least 0.4 mil thick is dried. By "other optical properties" we refer particularly to specular reflectance "$R_s$" from which D/I is derived, and, haze, each of which may be measured by the DORI-gON instrument.

Difficult as it is to find an organic coating which does not substantially sacrifice optical properties of the article, it is more difficult to find an organic coating which has excellent weatherability, yet has sufficiently good adhesion on the highly reflective sheet, so that after the sheet is anodized and coated with the organic, the sheet may be shaped into products such as environmentally stable bright-finished product for decorative trim, lighting fixtures and the like, without cracking or crazing either the anodized surface or the organic coating, yet without substantially decreasing the sheet's optical properties.

In a specific application, a coil of the anodized and polymer-coated sheet is cut into strips to make automotive trim. Only one surface is coated with polymer, though both front and rear surfaces may be coated. The coated surface is then roll-formed in progressive rolling dies, cleaned, treated with a corona discharge, and an adhesive applied. In a subsequent step, the adhesive surface is covered with an elastomeric synthetic resinous strip; or, only a portion of a polymer-coated surface may be treated, coated with adhesive and covered with the strip of resin. In a specific embodiment, only those portions of the surface coated with adhesive is covered with an extruded thermoplastic resinous strip.

It is well known that chemical treatments are used to remove soiled and oxidized aluminum surfaces, to brighten them to a specular luster, and to develop various types of protective or decorative coatings. The greatest value of a chemical treatment is as a pretreatment for providing finishes, including organic coatings and laminates, anodizing, electroplating, etc. The adhesion of these finishes, and others, depends in great measure on the type and quality of the chemical pretreatment. A chemical pretreatment may be outstanding as a preparation for paint, but inadequate as a pretreatment for another finish. The result is that, over the years, hundreds of chemical treatments and finishes have been developed to meet diverse needs. (See *Aluminum* Vol III. Fabricating and Finishing, edited by Kent R. Van Horn, Chapter titled "Chemical Pretreating and Finishing" by George, D. J. et al. pg 587 American Society for Metals, Metals Park, Ohio).

Faced with the problem of making a highly reflective aluminum surface, one skilled in the art typically chooses an aluminum alloy with a known propensity to acquire and retain a high specular luster after being mechanically bright-rolled in coil form. If one starts with such an alloy, it is mechanically bright-rolled to a high luster, cleaned, and then either chemically brightened or electrobrightened, or both. The highly reflective surface thus produced is protected by a thin protective layer of aluminum oxide conventionally deposited by one of several anodizing processes.

Among numerous choices of highly reflective aluminum alloys is the use of one containing from 0.5–3% magnesium, from 0.2–0.5% silver, from 0.001–0.2% iron and from 0.01–0.15% silicon (see U.S. Pat. No. 3,720,508 to Brock et al, class 75/147); and an alloy consisting essentially of 0.25–1.5% Mg (see U.S. Pat. No. 4,601,796 to Powers et al, class 204/33), the balance in each case being aluminum. Because essentially pure aluminum has excellent reflectance, by far the most popular choices for aluminum alloys are those with a low content of alloying elements. Such alloys have inadequate strength for numerous applications which also require a specular reflectance greater than 45%, often greater than 60%. As might be expected, high strength aluminum alloys are not typically chosen for use in high reflectance applications. Yet these alloys of the AA 5XXX and AA 6XXX series, particularly 5657, 5252 and 6306, are the alloys of special interest for use in this invention.

A typical chemical brightening step uses an Alcoa 5 bright dip which comprises dipping the sheet in a hot mixture of 85% phosphoric acid, 70% nitric acid, and optionally, 98% sulfuric acid. Preferably 19 parts (by volume) $H_3PO_4$ is mixed with 1 part $HNO_3$ and from 0 to 0.5 part $H_2SO_4$. This ratio varies as the mixture is used repetitively. In addition the brightened surface may be etched in a 30–40% phosphoric acid etch for from 15 sec to about 1 min to ensure formation of a desired semi-specular finish.

The so-obtained reflective surface may be protected by various treatments including anodic oxidation, hydrothermal treatment or conversion coatings employing solutions which may contain chromic acid, chromates, phosphoric acid, phosphates and fluorides. Anodic oxidation, for example, in a sulfuric acid bath, has been the bath of choice since more than a score of years ago (when it was disclosed in U.S. Pat. No. 3,530,048 to Darrow class 204/58). A thinner and more compact coating was provided by the addition of a hydrophilic colloid to the surface during the anodizing step (see U.S. Pat. No. 3,671,333 to Mosier class 204/58). A sulfuric acid anodized coating was favored for a highly reflective coating as recently as five years ago (U.S. Pat. No. 4,601,796 to Powers et al class 204/33).

The approach was to provide as thin a coating as would provide protection without vitiating the specularity of the surface. However, thin oxide coatings of the prior art, no matter how produced on a highly reflective aluminum surface, are far too thick to withstand being sharply bent without "crazing", may provide adequate protection for a short time, but may not provide enough "texture" (familiarly referred to as "grab") to anchor a protective organic coating having excellent durability and optical properties. Further, a thin coating may craze when the strip of aluminum is bent over a 2.5 cm radius mandrel; an anodized coating not quite thin enough will also craze when bent to simulate a forming operation.

In the past, an electrolytic processing step in a phosphoric acid bath, after anodizing in a sulfuric acid bath, was used to provide a surface which was then electrocolored (see U.S. Pat. No. 4,022,671 to Asada class 204/42). But conversion coatings generally have a relatively low D/I because they tend to be colored. Further, conversion coatings provide a less than satisfactory bond, for our purpose, with even the most preferred matrix fluoropolymer.

Another coating on aluminum which was produced with phosphoric acid anodizing followed by AC electrocoloring resulted in a surface with excellent optical properties, as disclosed in French Demande No. 2,360,051 to Showa Aluminum K. K. The process is carried out under constant current conditions of 1 to 1.5 amps/square decimeter. There is no indication as to how bright the sheet is after it is chemically cleaned, nor what the effects of the anodizing and coloring were. There is no indication whether any organic coating would adhere satisfactorily to the surface, least of all a matrix fluoropolymer containing at least 40 mol% of fluoroolefin units, known to produce a cured film of matrix fluoropolymer most difficult to adhere to a smooth metal surface (see U.S. Pat. No. 4,070,525).

Particularly with respect to providing an oxide coating (film) with a phosphoric acid electrolyte, one must achieve a satisfactory balance between anodic coating formation and dissolution of the film in the electrolyte. Sufficient film must be grown to give adequate structural strength to the film and to provide an adequate surface area to give improved adhesion. Equally, dissolution of the film must take place so that the original pore structure is enlarged. However, this attack must not be sufficient to cause breakdown and powdering of the film. With an acid such as phosphoric acid which is capable of strongly attacking the anodic film such a balance is difficult to achieve, particularly when anodizing at high speeds on continuous treatment lines. (See U.S. Pat. No. 4,681,668 to Davies et al, col 2, lines 48-60).

The '668 patent successfully produced a sufficiently thick film from 15 nm to 200 nm thick and required a current density of at least 250 amps/sq.M. As is well known, film growth is controlled essentially by the anodizing current density, and with short contact times such as are available in a bath for continuously treating aluminum strip, one would expect to use a lower current density than 250 A/m$^2$. But it would seem an exercise in futility to provide such a film in view of the '668 teaching that it would not be sufficiently thick unless a very high current density was used.

SUMMARY OF THE INVENTION

It has been discovered that decorative trim may be produced from an aluminum strip having substantially mirror-like characteristics, if it is first phosphoric acid ($H_3PO_4$) anodized with a thin oxide coating, then coated with a light-permeable matrix fluoropolymer coating less than 1 mil thick, which is preferably solution-deposited and cured. At least a portion of the strip may be shaped around a mandrel having a radius less than 10 mm, and the coated strip aged, without debonding the matrix fluoropolymer from the oxide coating at their interface. A strip, so shaped, is characterized by maintaining a D/I of at least 80%, and essentially no loss of adhesion, measured by a Half-T Bend test, and often, a Zero-T Bend test.

It is therefore a general object of this invention to provide a shaped strip of arbitrary length which may be substituted for polished stainless steel and/or bi-metal and used under comparably aggressive conditions for a prolonged period without deleteriously affecting the initial D/I of the shaped strip, and substantially without culpable prejudice vis-a-vis polished stainless steel or bi-metal in the market place.

It has also been discovered that identified steps of the process of this invention are essential to produce a shapeable, doubly-coated strip, less than 5 mm thick, of aluminum alloy having a substantially mirror-like surface, characterized by being able to meet a host of test conditions. An essential test is that the doubly-coated and shaped strip, after 2500 hr QUV/UVCON exposure set forth in a specific test, SAE J2020, necessarily maintains (i) a minimum 80% D/I (ii) and essentially no loss of adhesion.

It is therefore a general object of this invention to provide a process for making a reflective strip of aluminum alloy, doubly-protected with a sequential combination of an oxide generated by phosphoric acid anodizing ("PAA oxide") and a cured fluoropolymer, which strip is substantially free of degradation due to environmental exposure, comprising, (a) cleaning the surface of a sheet of aluminum in the range from about 0.010" (inch) to about 0.050" thick with solvent, alkali or acid to remove superficial contaminants, (b) chemically or electrochemically brightening the cleaned sheet, preferably in a phosphoric acid and nitric acid bath, (c) generating on said surface a porous aluminum oxide coating in the range from 100 nm (nanometers) (0.1 μm) to 0.2 mil (5 μm) thick, preferably from 0.1 μm to 3 μm thick, and most preferably more than 200 nm (0.2 μm) but no more than 2 μm thick, in a 5% to 20% phosphoric acid bath at from 25° C. to 75° C., more preferably from 25° C. to 50° C., under direct current (DC) applied to the sheet at from about 5 to 50 amps/ft$^2$ (8.25 to 82.5 coulombs/dm$^2$) at constant voltage in the range from about 10 to 50 volts, the oxide coating deposited within less than 3 minutes, without etching said surface, so as to produce a phosphoric acid anodized reflective surface having at least 80% D/I, (d) rinsing the phosphoric acid anodized surface to remove electrolyte, preferably with water, and drying, (e) contacting the reflective surface with a matrix fluoropolymer in an amount such that, upon curing, a cured matrix fluoropolymer is interstitially mechanically bonded to the oxide coating, so as to form a dual-coated strip which maintains at least 80% D/I, and, (f) shaping the dual-coated strip to conform to a profile having at least one radius which is less than 10 mm without debonding the cured matrix fluoropolymer from the oxide coating at their interface.

It has further been discovered that the surface of the matrix fluoropolymer has essentially no microscopic irregularities so that no known strip of organic thermoplastic polymer is directly sufficiently adhesively bondable to the surface of the matrix polymer to pass the SAE J2020 test. However if the surface of the matrix fluoropolymer of the foregoing doubly-coated substantially mirror-like strip of aluminum alloy is treated with a corona discharge, the polymer surface in turn, may be coated with an adhesive which, upon curing, is bonded to the microscopic irregularities of the treated surface. A strip of laminar thermoplastic polymer may thereafter be cohesively bonded to the doubly-coated strip. By "cohesive bonding" we refer to a bond between the strip of vinyl polymer and matrix fluoropolymer being so strong that, in a peel test, the vinyl strip will be damaged, as evidenced by a portion of the vinyl strip adhering to the matrix fluoropolymer when the vinyl strip is torn away. In contrast, an "adhesive bond" is one in which the vinyl polymer is cleanly peeled away from the matrix fluoropolymer, or, the matrix fluoropolymer is peeled away from the anodized aluminum surface; in either case the adhesive bond is such that the vinyl strip is undamaged, indicating neither the bond between the adhesive and vinyl, nor that between the matrix fluoropolymer and oxide coating, is strong enough to damage the vinyl.

It is therefore a general object of this invention to provide a process for producing a laminate of the foregoing doubly-coated aluminum strip with a laminar thermoplastic polymer, comprising, electrically treating the surface of the matrix fluoropolymer with a corona discharge sufficiently to provide a receptive surface for an adhesive, and contacting the adhesive with the laminar thermoplastic polymer under pressure for sufficient time to be cohesively bonded thereto.

It is a specific object of this invention to provide a shaped article of an anodized aluminum alloy containing from 0.25% to 2.8% magnesium and less than 1% silicon, coated with a matrix fluoropolymer which is in turn coated with an adhesive and coextruded with a thin laminar strip of a vinyl polymer to form a laminated coextrudate. The laminar coextrudate is uniquely characterized by the vinyl strip being cohesively bonded to the organic coating.

BRIEF DESCRIPTION OF THE DRAWING

The foregoing and additional objects and advantages of the invention will best be understood by reference to the following detailed description, accompanied with schematic illustrations of preferred embodiments of the invention, in which illustrations like reference numerals refer to like elements, and in which.

DETAILED DESCRIPTION OF PREFERRED EMBODIMENTS

The use of a soluble matrix fluoropolymer ("fluoropolymer" for brevity) is essential to provide the polymer coating on the reflective oxidized surface, as is the phosphoric acid anodized surface to which the fluoropolymer is non-adhesively bonded. The fluoropolymer consists essentially of at least 40 mol percent of a vinyl fluoride or vinylidene fluoride monomer which characteristically, when solidified, produces so uniformly smooth and regular a surface that, without benefit of being etched or otherwise treated to provide a receptive surface, cannot function as an adhesive to adhere two materials; nor can the fluoropolymer adhere to surfaces of commonly used metals sufficiently to withstand a peeling force of 10 lb. By "nonadhesively bonded" we refer to bonding achieved because of long fluoropolymer chains becoming entangled with a profusion of tendrils, and lodged in the columnar pore structure of the phosphoric acid anodized surface, in much the same manner as a piece of rope can be entangled in a thicket. Most preferred is a curable fluorocopolymer comprising 40 to 60 mol% of fluoroolefin units, 5 to 45 mol% of cyclohexyl vinyl ether units, 5 to 45 mol% of alkyl vinyl ether units and 3 to 15 mol% of hydroxyalkyl vinyl ether units, the polymer having an inherent viscosity of 0.05 to 2.0 dl/g in tetrahydrofuran at 30° C. Such a fluoropolymer is disclosed in U.S. Pat. No. 4,345,057 to Yamabe et al, the disclosure of which is incorporated by reference thereto as if fully set forth herein. The fluoropolymer is used without prior priming of the oxided surface, without a primer in the fluoropolymer, and without pigments or fillers which will denigrate the desired high D/I of the coated strip of trim. Most preferably the fluoropolymer is deposited from a solution containing from 5% to 30% by weight of fluoropolymer in methyl iso-butyl ketone (MIBK), by dipping the anodized sheet in a bath of the solution, or by roll-coating the solution onto the sheet, or by spray-coating the solution onto the sheet. The fluoropolymer may also be deposited from a dispersion of microscopic particles in a liquid dispersant medium, or by contacting the sheet with solid microscopic particles of the fluoropolymer, but typically, with less control than when deposited from solution.

Figure 1:
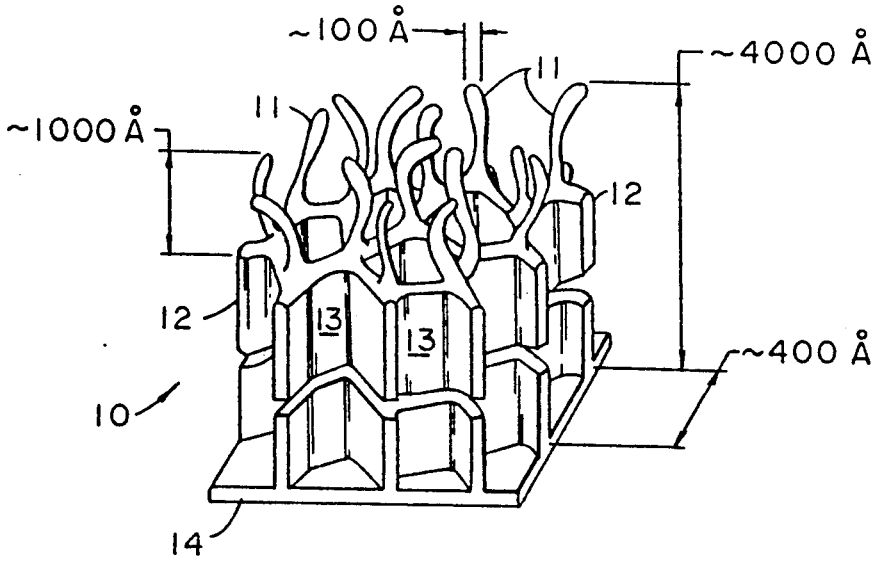
FIG. 1 is a perspective view schematically illustrating a representative portion of a layer of aluminum oxide formed by the phosphoric acid anodizing step of this invention.

Referring to FIG. 1 there is schematically shown the morphology of the shallow pore structure of an oxide coating, referred to generally by reference numeral 10, produced by the phosphoric acid anodizing treatment described herein. This structure, originally described by J. D. Venables et al in "Applications of Surface Science" Vol 3, pg 88–98, 1979, is shown in "The Surface Treatment and Finishing of Aluminum and its Alloys" by S. Wernick et al, 5th edition, Vol 1 published by ASM International, Metals Park, Ohio. The overall thickness of the coating is 4000 Å (400 nm), the upper portion being a mass of tendrils (or whiskers) 11 which are about 1000 (100 nm) in height and about 100 Å thick. The tendrils 11 protrude from the upper surfaces of the walls of short columnar structures 12 which define shallow pores 13 about 400 Å in diameter. The columnar structures 12 rise from a thin base layer of oxide 14 the thickness of which is not known, but which is thinner than either the height of the tendrils or that of the columns from which the tendrils protrude. The profusion of tendrils 11 generate a multiplicity of microscopic interstitial irregularities, as do the columnar structures 12. Such a structure is readily distinguishable from an acidetched structure which is typically deeply etched into the surface and provides irregularities which are readily distinguishable in an electron photomicrograph.

In one preferred embodiment of the invention, a sheet of bright-rolled aluminum about 0.010" to about 0.040", preferably about 0.020" thick, is solvent-cleaned or washed in a detergent or acid solution, or both, then chemically brightened, and/or brightened with an electro-brightener, to provide one surface with as substantially mirror-like a finish as can reasonably be achieved. A chemical brightener, for example Alcoa 5, comprises contacting the deoxidized sheet with a hot mixture of the brightener in the temperature range from about 50°–125° C.

The polished and brightened surface is then conventionally phosphoric acid anodized to provide a thickness of oxide which, if greater than 0.2 mil (5 μm) thick, will not meet the criteria of the polymer-coated article to be produced. The oxide thickness is therefore preferably maintained in the range from 0.05 μm to 3 μm thick, most preferably more than 200 nm but less than 2 μm thick.

Alternatively, a sheet of as-received aluminum is degreased and cleaned with an alkaline cleaner. The alkaline cleaner is removed in a hot water rinse and the surface is deoxidized by exposure to a suitable etchant such as dichromate-sulfuric acid deoxidizer, for example, a commercially available deoxidizer available under the brand Amchem in grades #6–16 to which nitric acid is added. A recipe for a suitable etchant is 4 to 9% by volume Alcoa 5 and 10 to 20 oz/gal nitric acid in an aqueous solution. The sheet is held in the solution at 65°–90° F. for a period sufficient to deoxidize one or both surfaces of the sheet.

The cleaned surface may be mechanically finished or polished, and treated in a brightening bath to make the surface as highly reflective as practical before it is phosphoric acid anodized and coated. Treatments to provide the deoxidized surface with near-mirror-like reflectivity are known in the art and form no part of this invention.

Preferred aluminum alloys are those relatively high purity aluminum alloys conventionally used in reflectorized aluminum articles. Such alloys typically contain no more than 2.8% magnesium, 0.2% iron, and 0.2% silicon. As the purity of the aluminum decreases, iron and silicon impurities, and other constituents and their reaction products collect in the oxide finish and contribute to a lower reflective surface. Most preferred for decorative automotive trim are high strength alloys, e.g. those in the 5XXX series, specifically 5252, 5552 and 5657; those in the 6XXX series, specifically 6306; and those in the 7XXX series, specifically 7029.

Though the initial cleaning and chemical and/or electro-brightening steps are carried out with well known etching and brightening pretreatments, it is essential that they result in a highly polished surface having a D/I of at least 80%, more preferably at least 90%. It will be evident that the D/I of the finished polymer-coated strip will not be better than that obtained after the initial pretreatment.

A preferred pretreatment is the Alcoa 5 treatment in which an aluminum sheet is dipped for from 10 sec to 4 min at from 90° C.–125° C. at atmospheric pressure, in a bath containing from 70%–80% $H_3PO_4$, from 2–4% $HNO_3$ and less than about 1% $H_2SO_4$ by weight, the remaining being water, except for traces of other materials.

The resulting highly reflective surface is anodized in a DC bath at constant voltage in the range from 10 to 50 volts, preferably from 10–30 volts. The anodizing bath consists of 5 to 15% by weight of $H_3PO_4$ at from 20° C. to 50° C. The anodization is carried out over a period long enough to provide a total current density of from 1–20 amps/ft$^2$ (1.65 to 33 coulombs/dm$^2$) of surface, typically less than 10 min, and the anodizing process is most preferably carried out continuously. At constant voltage and measurement of the cumulative current flow, the thickness of the anodized coating may be accurately determined. The anodized surface is rinsed in water and dried. The anodized surface is not colored in an electrocoloring step.

As long as the thickness of the phosphoric acid anodized oxide coating is in the ranges specified hereinabove, the needle-like structure of tendrils extending above the columnar porous structure of oxide, together provide the necessary base to ensure chain entanglement of the fluoropolymer which is applied to the surface as a solution in a suitable, removable organic solvent. Upon removal of the solvent, the fluoropolymer forms an interstitially bonded light-permeable coating which does not significantly diminish the D/I and specularity of the polymer-coated surface.

Though the process for phosphoric acid anodizing a substantially mirror-like aluminum sheet is conventional, it was not known that a phosphoric acid anodized coating preferably less than 0.12 mil (3 μm) thick, most preferably less than 0.05 mil (1.3 μm) thick, on a wide array of aluminum alloys known to produce a highly reflective surface when conventionally treated, would provide a critical thickness of a columnar porous oxide with upwardly extending tendrils which, when coated with the fluoropolymer, does neither substantially diminish specularity nor dull the D/I of the surface below 80%, and more preferably below 90%.

The discovery that such an anodized aluminum surface provides purchase or "grab" for a thin layer of the matrix fluoropolymer, and that the fluoropolymer is the only synthetic resinous coating able to provide the desired weatherability without substantially decreasing the D/I of the surface; and, the discovery that the aluminum sheet having such a highly reflective surface may be formed with a relatively small radius without delaminating the fluoropolymer coating, are among the many unexpected properties which make the reflective sheet of this invention unique.

Most preferred are fluoropolymers commercially available as ICI 302, ICI 504 and ICI 916 which are believed to be substantially similar to those disclosed in the aforementioned Yamabe et al '057 patent.

Phosohoric Acid Anodized, Fluoropolymer-Coated strip

Depending upon the particular aluminum alloy chosen, the desired %D/I, and other factors, the electrolytic bath preferably contains from 10% to 15% aqueous $H_3PO_4$, and is maintained at a temperature in the range from 30° C. to 40° C. Most preferably, a roll of the strip to be coated is continuously anodized on both sides, the duration of any portion of the strip in the bath being in the range from 20 sec–5 min, preferably 30 sec–1 min, depending upon the current density. While direct current is preferred, alternating or pulsed current or combinations of AC/DC may be used.

In an illustrative example, a strip of AA5XXX (5657 or 5252) or AA6XXX (6306) about 20 mils thick is solvent cleaned and chemically brightened in a Alcoa 5 bath so that both sides are cleaned. The strip is then anodized in an electrolyte comprising 10% $H_3PO_4$ acid by weight at constant voltage of 15 volts, or 15 amps/ft$^2$ (25 coulombs/dm$^2$), for about 1 min, while the bath is maintained at a temperature of 95° F. The result is a very thin oxide coating in the range from 5 nm to 20 nm thick, in which the coordination number of the aluminum-oxygen-phosphorus (Al-O-P) linkage is 4 and 6, as determined by NMR (nuclear magnetic resonance) measurements. The Al-O-Al coordination is predominantly octahedral with about 10% being tetrahedral.

The anodized strip is rinsed and thoroughly dried before it is spray-coated or preferably roll-coated with a solution of the curable fluoropolymer. The thickness of the roll-coated solution is such that upon removal of solvent and curing of the fluoropolymer, it remains as a smooth uniform coating about 0.5 mil thick. A thickness of fluoropolymer less than 0.1 mil thick does not provide desirable protection therefore a thickness in the range from about 0.1 mil to about 0.7 mil is preferred.

Preparation of High D/I Strips with Different Coatings

Different sections of the same sheet of mechanically polished and chemically and/or electrochemically brightened aluminum having a D/I of 90% (measured immediately after brightening the surface), are anodized with different processes to form the same 0.01 mil (0.25 μm) thickness of oxide. The anodized surfaces are then coated with the same 0.5 mil (12.5 μm) thickness of polymer film unless a thicker film was required to provide a wrinkle-free (no "orange-peel") surface. Each coated strip is then tested to determine whether it passed the requirements of strips having three essential properties. Since failure with respect to any one of the three properties categorized a strip as being commercially unacceptable, not all tests were carried out for each strip if it failed one of the tests. The unique properties of the combination of the fluoropolymer on a phosphoric acid anodized surface in comparison with other conventionally used light-permeable polymeric coatings, and other oxide coatings each of which is formed in the aforementioned same thicknesses, is demonstrated in the following grid:

| COMPARISON | | |
|---|---|---|
| Polymer coating | Oxide | Test |
| Acrylic | Chrome phosphate | Zero-T Bend* |
| Polyurethane | Sulfuric acid | Cond'ing Hum'ty* |
| Epoxy resin | $H_3PO_4$ anodized | QUV/UVCON* |
| Fluoropolymer | | |

*the details of the test are provided herebelow.

The following test results were obtained for an aluminum strip 20 mils thick which was pretreated as specified below to result in an oxide coating typically 0.01 mil (0.25 μm) thick, and coated with a highly weather-resistant powder of an acrylic polymer commercially available such as Glidden 4C–102 (from Glidden) which was used to provide a film from 1.5 mil–2.0 mil (38–51 μm) thick because a film 0.5 mil (13 μm) thick resulted in an "orange peel" surface.

| ACRYLIC COATING | | |
|---|---|---|
| Pretreatment | Test | Result |
| Bright dipped & | T-Bend | Not tested |
| chrome phosphate | Cleveland Condensing | Pass* |
| conv'n coated | QUV/UVCON | Fail |
| Bright dipped & phos- | T-Bend | Not tested |
| phoric acid anodized | Cleve. Condensing | Pass |
| | QUV/UVCON | Fail |
| Bright dipped & sul- | T-Bend | Not tested |
| furic acid anodized | Cleve. Condensing | Pass |
| | QUV/UVCON | Fail |

*no visual degradation of the surface

The following test results were obtained for an aluminum strip 20 mils thick which was pretreated as specified below to result in an oxide coating typically 0.01 mil (0.25 μm) thick, and coated with a polyurethane such as one available as Mobay 11T (from Mobay Chemical) which provides a film 0.5 mil (13 μm) thick.

| POLYURETHANE COATING | | |
|---|---|---|
| Pretreatment | Test | Result |
| Bright dipped & | T-Bend | Pass |
| chrome phosphate | Cleveland Condensing | Pass |
| conv'n coated | QUV/UVCON | Fail |
| Bright dipped & phos- | T-Bend | Pass* |
| phoric acid anodized | Cleveland Condensing | Pass |
| | QUV/UVCON | Fail |
| Bright dipped & sul- | T-Bend | Fail |
| furic acid anodized | Cleveland Condensing | Fail |
| | QUV/UVCON | Pass |

*only the Half-T Bend test

The following test results were obtained for an aluminum strip 20 mils thick which was pretreated as specified below to result in an oxide coating typically 0.01 mil (0.25 μm) thick, and coated with an epoxy resin commercially available as Epon®1009 (from Shell Chemical) which provides a film 0.5 mil (13 μm) thick.

| EPOXY RESIN COATING | | |
|---|---|---|
| Pretreatment | .Test | Result |
| Bright dipped & | T-Bend | Fail |
| chrome phosphate | Cleveland Condensing | Fail |
| conv'n coated | QUV/UVCON | Not |

-continued

| EPOXY RESIN COATING | | |
|---|---|---|
| Pretreatment | Test | Result |
| | | tested |
| Bright dipped & phosphoric acid anodized | T-Bend | Fail |
| | Cleveland Condensing | Fail |
| | QUV/UVCON | Fail |
| Bright dipped & sulfuric acid anodized | T-Bend | Fail |
| | Cleveland Condensing | Fail |
| | QUV/UVCON | N. T.* |

*Not Tested

Though adhesion was good with the epoxy it was too brittle to pass the T-bend test; it also "chalked" in the Cleveland Condensing test.

The following test results were obtained for an aluminum strip 20 mils thick which was pretreated as specified below to result in an oxide coating 0.03 mil thick, and coated with a fluoropolymer commercially available as ICI 302 (from ICI Ltd) which provides a film 0.5 mil (13 μm) thick.

| FLUOROPOLYMER COATING | | |
|---|---|---|
| Pretreatment | Test | Result |
| Bright dipped & chrome phosphate conv'n coated | T-Bend | Pass |
| | Cleveland Condensing | Fail |
| | QUV/UVCON | Pass |
| Bright dipped & phosphoric acid anodized | T-Bend | Pass |
| | Cleveland Condensing | Pass |
| | QUV/UVCON | Pass |
| Bright dipped & sulfuric acid anodized | T-Bend | Pass |
| | Cleveland Condensing | Fail |
| | QUV/UVCON | Pass |

The following test results were obtained for an aluminum strip 20 mils thick which was pretreated to provide a D/I of 90% and phosphoric acid anodized to provide an oxide coating of specified thicknesses. The oxidized surface of the strip retained a D/I of 90%. This mirror-like strip was coated with a PPG Durabrite fluoropolymer from a solution in which toluene and MIBK (methyl-isobutyl ketone) are cosolvents to form a film 0.5 mil (13 μm) thick.

| FLUOROPOLYMER COATING 0.5 MIL THICK | | |
|---|---|---|
| Oxide Coating (mil) | Test | Pass? |
| 0.003 mil (0.075 μm) | Zero-T Bend | Yes |
| | D/I | >80% |
| 0.03 mil (0.75 μm) | Zero-T Bend | Yes |
| | D/I | >80% |
| 0.3 mil (7.5 μm) | Zero-T Bend | No |
| | D/I | <80% |

It will be appreciated that the manner in which the sheet is mechanically polished, if such polishing is deemed necessary, solvent cleaned or washed with detergent, and chemically or electrochemically brightened, is not narrowly critical so long as the desire minimum D/I is produced. Further, the chrome phosphate conversion coating and the sulfuric acid anodized surfaces were produced using conventional, commercially used procedures. Irrespective of how the protective oxide layer is formed, it is essential that each of the anodized and fluoropolymer-coated (doubly-coated) reflective strips have properties which enable it to pass the foregoing three critical tests.

It will be noted that the phosphoric acid anodized strip coated with the specified polyurethane and epoxy resins passed all three tests. However, these strips fail to meet some of the other criteria set forth in additional tests, summarized in Table 1 herebelow, which a commercially acceptable doubly-coated strip must also meet. The fluoropolymer-coated reflective strip has numerous other properties which are best evidenced by its ability, acceptably to pass each of the tests identified in Table 1, along with a summarized description of essential elements of the test specified.

TABLE 1

| Test | Test Specification (summarized) |
|---|---|
| 1. Scratch Test | Knife @ 30° angle, cut to base metal |
| 2. Scribe Test | Cross-hatch cuts to base metal plus tape pull |
| 3. Chip Resistance | ASTM D3170, SAE J400 (Gravelometer) |
| 4. Gravelometer/ Salt Spray | SAE J400 Gravelometer plus 48 hr ASTM B117 Salt Spray |
| 5. Acid Spotting | 0.20 cc of 2.5N HCl acid on surface for 10, 20, and 30 min @ 38° C. |
| 6. Water Spotting | 16 hr in Weather-O-Meter, 2 ml distilled water on surface, oven bake 4 hr @ 60° C. |
| 7. Soap Spotting | 16 hr in Weather-O-Meter, 2 ml liquid soap on surface, oven bake 4 hr @ 60° C. |
| 8. Resistance to xylene | 10 circular rubs with xylene-wetted cheese-cloth |
| 9. Resistance to naphtha | Immerse 1 hr in naphtha @ 24° C. |
| 10. Resistance to Detergent | ASTM D2248 - 24 hr immersion in Calgon Triple C detergent 24° C. |
| 11. High Pressure | 10 sec of water spray @ 45° angle, 8 inch distance from (i) scribed and (ii) unscribed surface |
| 12. Cleveland Condensing Humidity | ASTM 2247 - 1000 hr @ 38° C. and 100% Humidity |
| 13. Oven Aging | 7 days @ 70° C., 3 days condensing humidity @ 38° C., knife cross-hatch adhesion test |
| 14. Water Immersion | ASTM D870 240 hr immersion in deionized water at 32° C. |
| 15. Cold Checking Cycle | 10 cycles - 16 hr condensing humidity @ 38° C., 4 hr @ −30° C., 2 hr @ 24° C., 2 hr @ 65° C. |
| 16. Salt Spray | ASTM B117 - exposed 1000 hr to 5% salt spray @ 49° C. |
| 17. Fluorescent UV and Condensation | SAE J2020 - cycle is 4 hr condensing humidity at 50° C., 8 hr fluorescent UV (B bulbs) at 70° C. - 2500 hr total |
| 18. Thermal Shock | 3 hr in 38° C. water, 3 hr in −29° C. freezer, scribing and direct steam blast; also, 4 hr in 32° C. water, 4 hr in −29° C. freezer, scribing and direct steam blast. |

Preparing a Laminate of the Fluoropolymer-coated Strip and a Thermoplastic Strip In all instances where the thermoplastic strip is laminated to the surface of the fluoropolymer coating, the strip is adhesively bonded to the fluoropolymer. Before the adhesive is applied, the fluoropolymer coating is subjected to a corona discharge treatment. By "corona discharge treatment" or "corona treating" refers to subjecting the surface of a solid fluoropolymer coating to a corona discharge, i.e. the ionization of a gas, typically air, in close proximity to the surface of the coating, the ionization being initiated by a high voltage passed through a proximately disposed electrode and causing oxidation and other changes to the surface of the coating. Either of two types of corona treatment may be employed. A bare electrode may be used in combination with an insulated roll, e.g. a rubber insulated roll. Alternatively, a glass electrode may be used in conjunction with a bare metal roll. Most preferred is an apparatus comprising a pair of spaced electrical conductors and a power source for supplying an alternating electrical voltage across the conductors, at least one conductor having an electrode member mounted thereto in electrical contact, the electrode member being formed from a dielectric material having a dielectric constant of at least 8 and extending towards the other conductor to define between the electrode member and the other conductor, or another electrode member extending from the other conductor, a gap in which a corona discharge can form and through which the travelling fluoropolymer-coated strip can be drawn, the conductors being sufficiently spaced apart to preclude an arc discharge between the conductors.

The minimum distance apart of the electrical conductors required to preclude an arc discharge depends of course upon the voltage applied across the conductors. For example, when the applied voltage is 6 KV the conductors should not be spaced apart by less than 20 mm.

The travelling strip may be drawn through the gap by suitable drawing means which keep the strip out of contact with the electrode member and the other conductor or other electrode member. The electrode member may take the form of a plate in which an edge is directed towards the other conductor or may take the form of a series of abutting plates, e.g. ceramic plates. The dielectric material from which the electrode member is formed preferably has a dielectric constant of at least 80 and more preferably about 170. There is no specific upper limit but for practical purposes the dielectric constant should not exceed 750. The alternating voltage supplied by the power source is preferably from 6 to 20 KV at a frequency of from 2–50 Khz, more preferably from 2–30 Khz.

Figure 2:
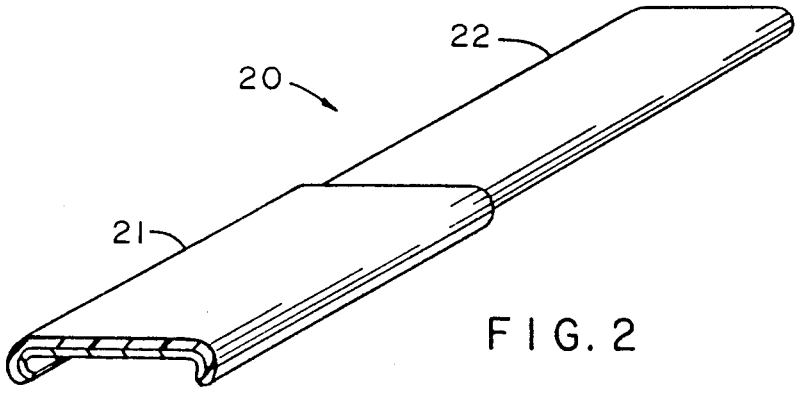
FIG. 2 is a perspective view of a section of coextruded aluminum strip of arbitrary length, one doubly-protected (far) portion of which has substantially mirror-like characteristics, and the other (near) portion of the strip is coated with a thermoplastic polymer coating which is adhesively bonded to the fluoropolymer coating.

Referring to FIG. 2 there is shown a strip 20 of 5252 alloy about 3 mm thick and 3 cm wide and of arbitrary length, which strip is doubly-coated with a phosphoric acid anodized coating 1 μm thick having shallow pores having a depth which is less than the thickness of the coating. The depth of pores, the dimensions of the tendrils, and the precise structures of the cells, and therefore the density of the oxide coating will depend upon the conditions used for producing the coating. Tendrils formed may range from about 25 nm to 2 μm in height, and from about 10 nm to 1 μm thick, and the pores may range from about 50 nm to 4 μm in diameter and from about 20 nm to 3 μm deep. Since there is no convenient way of measuring the density of the coating formed, suffice to state that the true density of the oxide formed is in the range from about 2.5–3.2 gm/cm$^3$.

The oxided strip is then coated with a fluoropolymer coating 0.5 mil thick. A portion (the near portion in the Fig) of the strip 20 has a thermoplastic strip 21 adhesively bonded to it after the matrix fluoropolymer coating is treated with a corona discharge and an adhesive applied to the treated surface. The far portion 22 of the strip 20 is not treated with a corona discharge because it is to be left bare, showing the highly reflective surface of the strip.

Figure 3:
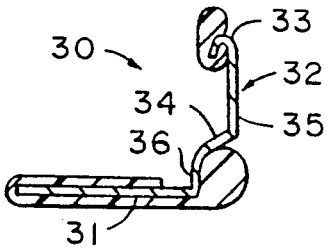
FIG. 3 is an end elevational view of another section of co-extruded aluminum strip of this invention, the upper and lower portions of which are coated with separate thermoplastic organic polymer coatings, an end of each of which is folded back upon itself over the aluminum strip, and the bright intermediate portion of the strip is left bare to exhibit its substantially mirror-like characteristics.

Referring to FIG. 3 there is shown an elevational view of another strip 30 of arbitrary length, about 20 mils thick, having a generally right-angular profile, including a laminar horizontal leg 31 1 cm long, and an arcuate vertical leg 32 about 18 mm high. Both legs are cleaned and anodized as described hereinbefore, then coated on both front and rear surfaces with a coating of fluoropolymer 0.5 mil thick (neither coating is visible in this drawing). The vertical leg 32 terminates in a hook 33 which is formed by bending the upper terminal portion of the leg over a mandrel having a radius of about 2 mm. The lower portion of the leg 32 is provided with a short acutely inclined portion 34 which connects the upper vertical section 35 of the leg 32 to its lower vertical portion 36, thus providing an indented lower surface of the leg 32.

Figure 4:
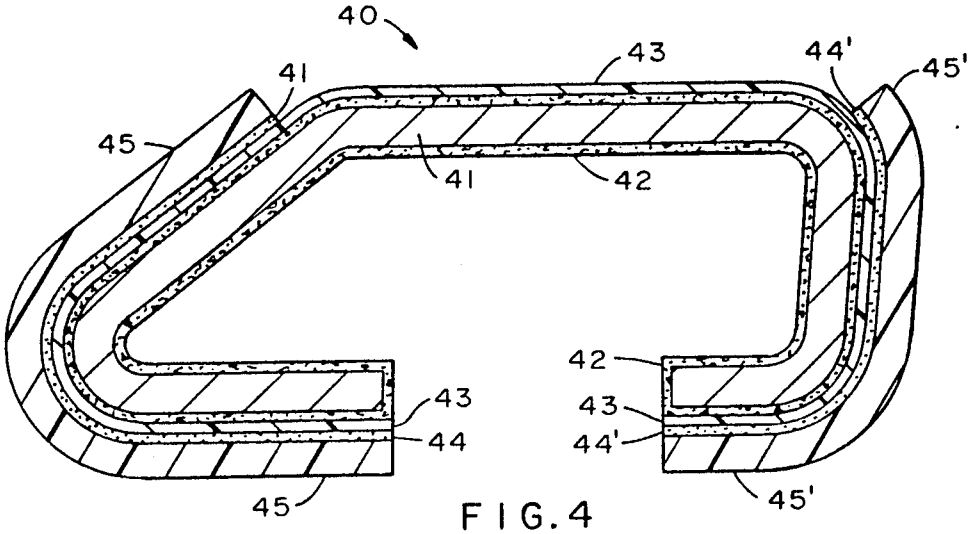
FIG. 4 is an end elevational view, greatly enlarged, to illustrate diagrammatically, the details of yet another section of co-extruded aluminum strip.

Referring to FIG. 4 there is shown a greatly enlarged view, not to scale, diagrammatically illustrating a cross-section of another co-extruded length of automotive trim identified generally by reference numeral 40. A shaped strip 41 of AA 5657 alloy about 4 cm (1.5") wide has an essentially uniformly thin aluminum oxide coating 42 generated over the entire surface of the strip. Only the outer (front) surface of the strip 41 is coated with matrix fluoropolymer 43. Since the mid-portion of the strip is to be left bright, an adhesive coating 44 and 44' is deposited over those corona-treated portions of the strip 40 to be covered with strips 45 and 45' of PVC.

In the illustrative example set forth herein, a portable corona treatment unit identified as Model PJ-2 Dual Discharge High Ouput Unit, manufactured by Corotec was used. The unit operates with an input of 120 volt at 5 Amps and 60 Hz frequency (single phase) and has an output of 10 KV at 0.1 Amp.

Though polymer coatings other than a matrix fluoropolymer, may benefit from a treatment with a corona discharge, it is not necessary to provide them with such treatment because their surfaces generally provide enough microscopic irregularities to permit adhesively directly bonding a strip of thermoplastic polymer, specifically a vinyl polymer, to the polymer coating, without a preliminary corona discharge treatment.

The doubly-coated reflective aluminum strip is converted to a laminate of (i) the reflective aluminum strip and (ii) a polymer strip of a suitable organic thermoplastic synthetic resinous material by cohesively bonding the strips, one to another, after at least a portion of the matrix fluoropolymer's surface is treated with an electric discharge, and by using an adhesive between the surfaces to be bonded. Though the bonding (rear) surface of the polymer strip is smooth, it has enough microscopic irregularities to be susceptible to bonding with an appropriate adhesive provided only if the exterior surface of the fluoropolymer is treated with the electric discharge. Such a discharge is conveniently provided by a portable unit identified hereinabove, operating at a setting of 10 Kv, 0.1 amps and 60 Hz. It will be appreciated that the precise amount of energy delivered by the corona discharge, and the conditions under which that energy is delivered, will vary depending upon the type of unit used, and the rate at which the travelling fluoropolymer-coated is to be treated. Only after being treated with the corona discharge, can the otherwise ultrasmooth exterior surface of the fluoropolymer be directly bonded to the polymer strip with an adhesive sufficiently well to be cohesively bonded.

The adhesive for the treated fluoropolymer surface is chosen specifically with respect to the particular thermoplastic polymer strip which is to form the laminate. For example, with a poly(vinyl chloride) strip the adhesive chosen is an acrylate-based adhesive such as BFGoodrich 1610 or 1617; for a polyethylene terephthalate strip the adhesive chosen is an acrylate-based adhesive such as AO-420 from ITW. The adhesive coating may be applied in a thickness in the range from 0.1 to about 3 mils to ensure sufficient adhesive to provide coherent bonding of the thermoplastic strip to the fluoropolymer, though from 0.2–0.5 mil is typically sufficient. It is preferred to apply the adhesive immediately prior to applying the polymer strip under pressure. This is most preferably accomplished by co-extrusion in a commercially available roll-former such as one fitted with an extrusion die as for example in a commercia Tishken or Yoder Y-line roll-former.

Figure 5:
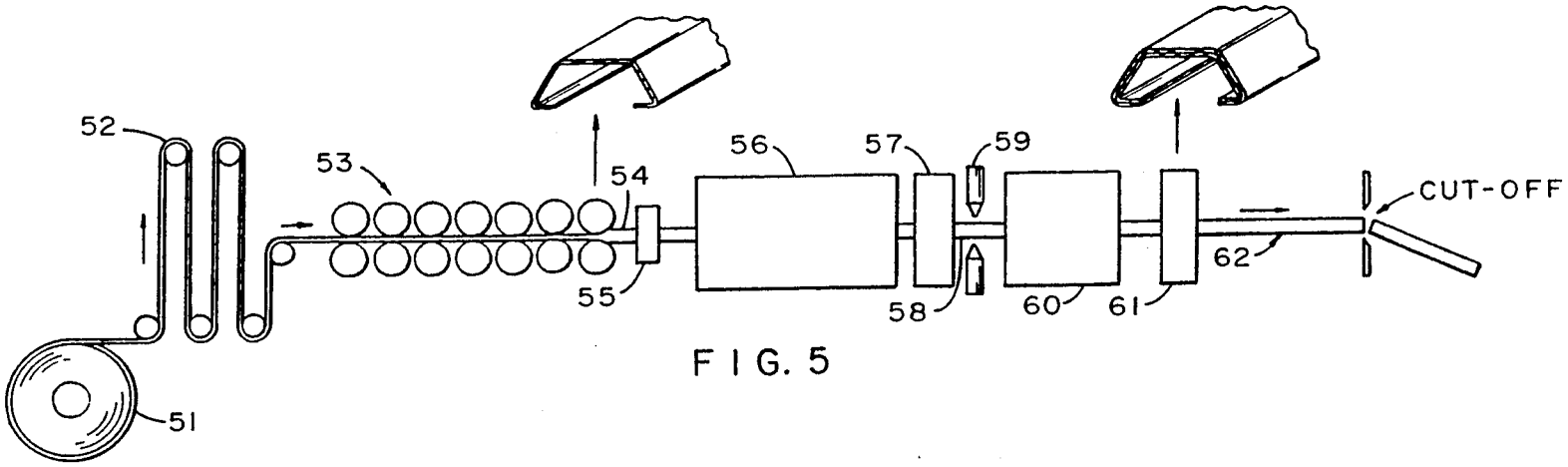
FIG. 5 is a flowsheet of a process for continuously forming co-extruded aluminum trim from fluoropolymer-coated sheet having a mirror-like surface protected by a soft interlayer of wax paper when the sheet is wound up in a coil (referred to as "prefinished" coil).

That portion of the process wherein the doubly-coated strip is converted to finished co-extruded trim is schematically illustrated in FIG. 5. There is shown a prefinished coil of about 4 cm wide doubly-coated aluminum alloy 51 mounted to be unwound as it is fed to an accumulator 52, then to a roll former 53 in which a plurality of rolls form the strip so that it leaves the roll former as a shaped doubly-coated strip 54 having the desired shape. The shaped strip 54 travels over a straightening block 55 and proceeds into a cleaning solvent (typically warm water with detergent, because the lubricating oils used in the roll-former are water-soluble). The cleaning solvent has no effect on the inert fluoropolymer. The cleaning solvent is held in cleaning tanks 56 from which the cleaned, shaped strip 54 travels to a corona discharge station 57. Corona-discharge-treated strip 58 proceeds to adhesive applicator 59 where a film of adhesive is uniformly applied to at least those portions of the strip 58 which are to be bonded to a thermoplastic strip. The width of the thermoplastic strip is typically no greater than the width of the doubly-coated strip so that the strips may be coextensively laminated as shown in FIG. 2, but may be substantially less so as to permit reflective portions of the doubly-coated strip to be visible as shown in FIGS. 3 and 4.

The adhesive-coated strip is heated in a heating zone, preferably with an induction heater 60 and the heated strip is fed to a plastic extruder 61 in which a thermoplastic strip (not shown) is co-extruded onto the adhesive-coated strip resulting in co-extruded strip 62. The thermoplastic strip is preferably scored with a sharp knife-edge at preselected intervals corresponding to those portions of strip which are to be left substantially mirror-like. The co-extruded strip 62 is then cut-off into desired lengths.

As indicated, the identity of the polymeric material, not a matrix fluoropolymer, which may be adhesively bonded to the treated fluoropolymer is limited only by the choice of adhesive which will coherently bond the polymer strip to the activated fluoropolymer coating. The following are among the commercially available polymeric materials (identified by standard symbols set forth in ASTM D4000) which may be adhesively bonded to the activated fluoropolymer surface: copolymers of styrene and/or α-methyl styrene and acrylonitrile such as copolymers of styrene and acrylonitrile (SAN); terpolymers of styrene, acrylonitrile and diene rubber (ABS); copolymers of styrene and acrylonitrile modified with acrylate elastomers (ASA); copolymers of styrene and acrylonitrile modified with ethylene propylene diene monomer (EPDM) rubber (ASE); polyvinyl chloride (PVC); chlorinated polyvinyl chloride (CPVC); siloxane cross-linked to form silicone rubber; nylon (a polyamide); polycarbonate (PC); thermoplastic polyesters.(TPES), including polybutylene terephthalate (PBT), polyethylene terephthalate (PET), aromatic polyester and polyether-ester segmented copolymers, such a Hytrel* by DuPont Corp.; polyurethane (PUR); and thermoplastic polyurethane (TPUR); polyphenylene oxide (PPO); polyacetals (POM); copolymer of styrene and maleic anhydride (SMA); polymers of acrylic acid, methacrylic acid, acrylic esters, and methacrylic esters; polyolefins; polyamide-imide; polyacrylonitrile; polyarylsulfone; polyester-carbonate; polyether-imide; polyether-ketone (PEK); polyether-ether-ketone (PEEK); polyalphaether ketone (PAEK); polyether sulfone; polyphenylene sulfide; and polysulfone.

Most preferred are the co-extrudable thermoplastic polymers such as PVC, CPVC, polyolefins, particularly grafted polypropylene, TPUR, silicone rubber, PET and polysulfone.

In addition to being coherently bonded to the fluoropolymer coating, a specific poly(vinyl chloride) coextrudate made from pigmented Geon PVC having a specific viscosity of at least 0.20, and an intrinsic viscosity in the range from 0.95 to 1.2, exhibits exceptional physical properties as evidenced by the tests specified below in Tables 3 and 4.

The co-extruded strip is subjected to numerous tests to determine whether it will be a suitable substitute for bright stainless steel or bi-metal. Among such tests are ones used for accelerated exposure testing, and others used for natural outdoor exposure testing. Such tests which together provide evidence for substitutability are listed herebelow in Tables 2 and 3. The PVC-coextruded strip of this invention passes all the tests identified with the appropriate test number, and succinctly described herebelow.

TABLE 2

ACCELERATED EXPOSURE TESTING

| Test identif. | Test Specifications |
|---|---|
| $H_2S$ resistance: | HCl and $K_2S$ reactants for 10 sec (GM9069P) |
| $SO_2$ resistance: | $Na_2SO_4$ and $H_2SO_4$ reactants for 25 min (GM 9736P) |
| Naphtha resistance: | 1 hr immersion in aliphatic naphtha @ 24° C. |
| Detergent resistance: | 24 hr immersion in Calgon Triple C detergent @ 24° C. (ASTM D2248) |
| Gasoline resistance: | 3 hr immersion for 5 consecutive days (GM 9531P) |
| High Pressure Car Wash: | 10 sec water spray at 45° angle, 8" distance from scribed and unscribed surface (GM 9531P) |
| High Pressure Air: | Air blast @ 173 to 206 kPa (25–30 psig) |
| Cleveland Condensing Humidity: | 1000 hr @ 38° C. and 100% humidity (ASTM 2247) |
| Carbon Arc Weather-O-Meter: | 1600 hr (ASTM G23) |
| Fluorescent UV and Condensation (QUV): | Cycle of 4 hr condensing humidity @ 50° C. and 8 hr fluorescent UV (B bulbs) - 2500 hr total (SAE J2020) |
| Oven Aging: | 7 days @ 70° C., 3 days condensing humidity @ 38° C., knife cross-hatch adhesion (GM 9504) |
| High Temperature: | (1) 2 weeks @ 88° C.; (2) 30 min @ 121° C. |
| Water Immersion: | 240 hr in 32° C. DI water (ASTM D870) |
| Salt Spray: | 1000 hr of exposure to continuous 5% salt spray @ 49° C. (ASTM B117) |
| Thermal Shock: | (1) 3 hr in 38° C. water, 3 hr in −29° C. freezer, scribing and direct steam blast; (2) 4 hr in 32° C. water, 3 hr in −29° C. freezer, scribing and direct steam blast (GM 9525P) |
| Room Temperature Impact: | 1.1 Joules (10 inch pounds) with 13 mm impact head |
| Low Temperature Impact: | 0.57 Joules (5 inch pounds) with 13 mm impact head |
| Cold Checking Cycle: | 10 cycles - 16 hr condensing humidity @ 38° C.; 4 hr @ −30° C.; 2 hr @ 24° C.; 2 hr @ 65° C. (FLTM BI 107-02) |

TABLE 2-continued

| ACCELERATED EXPOSURE TESTING | |
|---|---|
| Test identif. | Test Specifications |
| Scratch Test: | Knife @ 30° angle, cut to base metal (FLTM BI 106-01) |
| Scribe Test: | Cross-hatch cuts to base metal plus tape pull with #610 high-tack Scotch$^R$ tape (FLTM BI 106-01) |
| Chip Resistance: | 550 ml gravel @ 480 ± 20 kPa (70 psi) (ASTM D3170; SAE J4000 Gravelometer) |
| Gravelometer with Salt Spray: | SAE J400 Gravelometer plus 48 hr ASTM B117 Salt Spray |

In the following outdoor tests, as in the foregoing tests of Table 2, a statistically significant number of coextruded strips of this invention were tested by being left outdoors for the time indicated. Data on other strips coated with matrix fluoropolymer are those obtained by others on bare aluminum, that is, having a naturally occurring oxide film because the aluminum strips were not given a specified anodizing treatment.

TABLE 3

| OUTDOOR EXPOSURE TESTING | |
|---|---|
| Co-extruded strips of this invention: | |
| South Florida: | 1 yr - no visually observable change. |
| Port Judith, Rhode Island (sea cost site): | 1 yr - no visually observable change. |
| New Kensington, PA.: | 1 yr - no visually observable change. |
| Prior art co-extruded strips: | |
| South Florida: | 3 yrs - no visually observable change. |
| Okinawa, Japan: | 5 yrs - no visually observable change. |

Having thus provided a general discussion, described the doubly-coated strip and co-extruded trim as well as the overall process for producing each article, and having illustrated the invention with specific examples of the best mode of making the articles and carrying out the process, it will be evident that the invention has provided an effective solution to a difficult problem. A fluoropolymer coating such as is used in U.S. Pat. No. 5,035,940, is interstitially mechanically bonded to an aluminum oxide coating on a mirror-like strip of aluminum without using an adhesive and substantially without sacrificing the D/I of the surface. The fluoropolymer is not debonded by sharply bending the strip which is thus doubly-protected against deterioration of its surface for at least one year. The ultra-smooth surface of such a strip requires corona treatment to bond an adhesive, mainly mechanically to the fluoropolymer surface, but the adhesive adhesively secures a thermoplastic strip to form a laminate. No undue restrictions are to be imposed by reason of the specific embodiments illustrated and discussed, except as provided by the following claims.

We claim:

1. A process for converting a sheet of aluminum alloy in the range from about 0.010 inch (0.25 mm) to about 0.050 inch (1.25 mm) thick, into a decorative reflective sheet, doubly-protected with a combination of an oxide coating formed by phosphoric acid anodizing, and, a sequentially applied cured fluoropolymer coating, said doubly-protected sheet having a surface substantially free of degradation due to environmental exposure, said process comprising, (a) cleaning said surface of said sheet of aluminum alloy to remove superficial contaminants and leave a clean surface;

(b) brightening said clean surface until said clean surface is a bright surface having substantially mirror-like characteristics with a distinctness of reflected image (D/I) of at least 80%;

(c) generating on said bright surface a porous aluminum oxide coating in the range from 100 nanometers (0.1 μm) to 0.2 mil (5 μm) thick, in a bath containing from about 5% to 20% by weight of phosphoric acid, at a temperature in the range from about 25° C. to 75° C., under direct current (DC) applied to said sheet at from about 5 to 50 amps/ft$^2$ at constant voltage in the range from about 10 to 50 volts, said oxide coating being deposited within less than 3 min, without first etching said surface, so as to produce a phosphoric acid anodized reflective surface having at least 80% D/I;

(d) rinsing said phosphoric acid anodized surface and drying, to leave a dry reflective surface;

(e) contacting said dry reflective surface with a fluoropolymer in an amount such that, upon curing, a cured fluoropolymer is interstitially mechanically bonded to said oxide coating, so as to form said reflective sheet doubly-coated on at least one side which maintains at least 80% D/I; and, (f) shaping said doubly-coated sheet to conform to a profile having at least one radius which is less than 10 mm without debonding said cured matrix fluoropolymer from said oxide coating at the interface thereof.

2. The process of claim 1 including in step (b), brightening said clean surface, chemically and/or electrochemically, in an aqueous bath consisting essentially of 85% phosphoric acid, 70% nitric acid, and optionally, 98% sulfuric acid, present in a volume ratio of about 19 parts $H_3PO_4$, 1 part $HNO_3$, and from 0 to 0.5 part $H_2SO_4$.

3. The process of claim 1 wherein said oxide coating is from 0.1 μm to 3 μm thick and said bath is at a temperature in the range from 25° C. to 50° C.

4. The process of claim 3 wherein said oxide coating is more than 200 nm (0.2 μm) but no more than 2 μm thick.

5. The process of claim 1 in which said fluoropolymer is thermally cured.

6. A process for coating at least one surface of an aluminum alloy sheet with an oxide coating and a fluoropolymer coating, said process comprising, (a) cleaning at least one surface of an aluminum alloy sheet;

(b) brightening the cleaned surface until it has a distinctness of reflected image (D/I) of at least 80%;

(c) generating on the brightened surface a porous aluminum oxide coating in the range from 100 nanometers (0.1 μm) to 0.2 mil (5 μm) thick, in a bath containing from about 5% to 15% by weight of phosphoric acid, at a temperature in the range from about 20° C. to 50° C., under direct current (DC) applied to said sheet at from about 1 to 20 amps/ft$^2$ at voltage in the range from about 10 to 50 volts, said oxide coating being deposited within less than 10 min, without first etching said surface, so as to produce a phosphoric acid anodized reflective surface having at least 80% D/I;

(d) rinsing said phosphoric acid anodized surface and drying, to leave a dry reflective surface; and (e) contacting said dry reflective surface with a fluoropolymer and curing said fluoropolymer to bond the fluoropolymer to said oxide coating, so as to form sheet coated on at least one surface with an oxide coating and a fluoropolymer coating which maintains at least 80% D/I and which is suitable to being shaped into a profile having at least one radius which is less than 10 mm without debonding said cured fluoropolymer from said oxide coating.

7. The process of claim 6 including in step (b), brightening said clean surface, chemically and/or electrochemically, in an aqueous bath containing at least one of phosphoric acid, nitric acid, and sulfuric acid.

8. The process of claim 7 in which said bath contains by weight 70–80% phosphoric acid, 2–4% nitric acid and less than 1% sulfuric acid by weight, the remainder being water.

9. The process of claim 6 wherein said fluoropolymer is thermally cured.

10. The process of claim 9 wherein said fluoropolymer is a thermally curable fluorocopolymer comprising 40 to 60 mol% of fluoroolefin units, 5 to 45 mol% of cyclohexyl vinyl ether units, 5 to 45 mol% of alkyl vinyl ether units and 3 to 15 mol% of hydroxyalkyl vinyl ether units, said polymer having an inherent viscosity of 0.05 to 2.0 dl/g in tetrahydrofuran at 30° C.

11. The process of claim 6 which includes shaping the fluoropolymer coated aluminum alloy sheet to form a profile having at least one radius which is less than 10 mm.

12. The process of claim 6 which includes, (f) treating a selected portion of said of the surface of said cured fluropolymer with a corona discharge; and (g) adhesively bonding a thermoplastic strip to the corona discharge treated surface of said sheet.

* * * * *